United States Patent [19]

Pries

[11] 4,372,672

[45] Feb. 8, 1983

[54] SELF-TRIGGERING QUALITY CONTROL SENSOR

[75] Inventor: Robert W. Pries, Longmont, Colo.

[73] Assignee: International Business Machines Corporation, Armonk, N.Y.

[21] Appl. No.: 219,122

[22] Filed: Dec. 22, 1980

[51] Int. Cl.[3] ..... G03G 15/00

[52] U.S. Cl. ..... 355/14 R; 118/665; 118/688; 355/3 DD; 355/14 D; 427/10

[58] Field of Search ..... 355/14 D, 3 DD, 14 R, 355/77; 118/665, 679, 688, 691; 250/206, 559; 427/10

[56] References Cited

U.S. PATENT DOCUMENTS

| | | | |
|---|---|---|---|
| 3,348,522 | 10/1967 | Donohue | 355/14 D |
| 3,812,372 | 5/1974 | Wirtz | 250/561 |
| 3,872,825 | 3/1975 | Davidson | 118/691 |
| 3,873,197 | 3/1975 | Whited | 118/691 X |
| 3,911,861 | 10/1975 | Griesmer | 118/7 |
| 3,926,338 | 12/1975 | Reyner | 355/3 DD |
| 3,969,114 | 7/1976 | Prats | 118/665 X |
| 4,082,445 | 4/1978 | Steiner | 355/3 DD |
| 4,178,095 | 12/1979 | Champion | 355/14 R |
| 4,179,213 | 12/1979 | Queener | 118/665 X |
| 4,183,657 | 1/1980 | Ernst et al. | 355/14 R |

*Primary Examiner*—R. L. Moses

*Attorney, Agent, or Firm*—Charles E. Rohrer

[57] ABSTRACT

A system for checking copy quality variables within an electrophotographic copier machine involving the production of a developed sample test area and a base reference test area on a photoreceptive surface. An optical transducer is used to view the test area and circuits are provided to produce an output signal indicative of quality. The circuit triggers itself by detecting a substantial change in transducer produced signal level when the sample test area is viewed, thus negating the requirement that the test circuits be operated under the control of the machine.

4 Claims, 7 Drawing Figures

SELF-TRIGGERING QUALITY CONTROL SENSOR

This invention relates to a quality control system in an electrophotographic copier machine and more particularly, to a system in which the quality control circuit triggers itself when a test is to be made.

RELATED PATENT

U.S. Pat. No. 4,183,657 relates to dynamic referencing methods and apparatus for an image quality control system. This invention represents an improvement to that patent.

BACKGROUND OF THE INVENTION

In document copier machines of the electrophotographic type, charged latent images are produced on a photoreceptive material and developed through the application of a developer mix. A common type of developer mix is comprised of two components, a carrier material, such as a magnetic bead, coated with toner particles. Where the photoreceptive material is separate from the copy paper itself, a transfer of the developed image to the copy paper must take place together with fusing of the developed image to the paper. It is the toner that is attracted to the charged, latent image to develop that image and it is the toner that is transferred from the latent image to the copy paper and fused thereto to produce the finished copy.

It is apparent from the procedure outlined above that toner is a supply item which must be periodically replenished in the developer mix since toner is carried out of the machine on the copy paper as a reproduced image. It is also apparent that the concentration of toner particles in the developer mix is significant to good development of the latent image since too light a toner concentration will result in too light a developed image and too heavy a toner concentration will result in too dark a developed image.

Other variables which seriously affect copy quality include the image voltage of the photoconductor and the bias voltage on the developer. Many other variables factor into these basic quantities, for example, the quality of the original, the cleanliness of the optical system, and the condition of the photoconductor.

For a quality control system that attempts to accurately control toner concentration, image voltage, and other quality rendering factors, the control system itself must be designed to be as free from internal error as possible. Previous systems include U.S. Pat. No. 2,956,487 which provides a toner concentration control system where the reflectivity of the image to be reproduced is used as a measure of toner density. This system appears subject to difficulty since reflectivity readings will change dependent upon the quality of the original. U.S. Pat. No. 3,348,522 discloses a toner concentration control scheme in which a special test image is developed outside the image area used for reproducing document copies. In this latter patent, separate reflectivity-sensing devices are used to simultaneously sense light reflected from a single light source, one sensing device to establish a voltage indicative of clear photoconductor outside the image area and the other to establish a voltage indicative of the test area which, as noted above, is also outside the image area. U.S. Pat. No. 3,348,523 is essentially similar to U.S. Pat. No. 3,348,522.

U.S. Pat. No. 3,926,338 discloses a circuit for use in a toner concentration control scheme where a thermally insensitive photodetector is used to nullify the effect of the large amount of heat generated during machine operation. Similarly, this patent says that a stable amplifying circuit, stable referring to temperature stability, must be used in order to avoid destruction of the validity of the sensed signal.

U.S. patent application Ser. No. 141,864, filed Apr. 21, 1980, relates to an electrophotographic copier machine in which a test area is placed on a part of the photoconductor within the image area itself during a separate test cycle. In that manner, the advantages of using a developed image are combined with the advantages of using the very same photoconductor that is used for document reproductions. It was found that on short runs the test cycle could correspond to a run-out cycle after the last copy had been produced. However, during long, multicopy runs, it may be necessary to skip an occasional copy in order to provide a test cycle, once every 10 copies, for example. The test cycle technique improves accuracy since there is a tendency for toner to build up on the image area with photoconductor usage; since the photoconductor surface characteristics change with use, thus affecting development; and since the photoconductor suffers electrostatic degradation with use. A result of these factors is that the image area itself becomes darkened as compared to the areas of the photoconductor which are not used for image impressions and the photoconductor does not charge as well as it does when fresh. When photoconductor charge is reduced, the voltage levels of a resultant latent image are changed as compared to new photoconductor and copies are produced which are too light. However, in the test cycle technique, where the test area is produced within the image area any results of toner filming, aging, use, etc., are present in the quality tests. Consequently, the absolute quantity of toner in the developer mix can be adjusted as the photoconductor changes and the value of the developer bias voltage can be changed to provide compensating factors for the effects of change. Such results are not possible unless the quality tests are taken within the image area. Even if the tests are taken within the image area, there is still no assurance that the results will be accurate unless the testing circuit is able to compare the resulting quantities to a meaningful reference and unless the quantities are devoid of circuit-induced nonlinearities.

In the related patent named above, it was discovered that it is advantageous to view a cleaned, uncharged area of the photoconductor within the image area in order to provide a reference voltage subject to the variables named above. Additionally, it was discovered that various elemental factors such as temperature as well as component nonlinearities prevented accurate comparisons of reference voltage and sensed voltage unless the identical sensor is used for both measurements and unless it is excited to similar levels during both measurements. In this regard, it was discovered that the amount of light received for both sample and reference measurements by the sensor must be made equal (at the correct quality level) to avoid photodetector nonlinearities and a circuit arrangement to provide this property was invented.

In the system described in related U.S. Pat. No. 4,183,657, a reference voltage is obtained and allowed to vary from test to test by viewing an untoned "bare" area of the photoconductor. The fact that the reference voltage is sensed each time a test is made by the same photodetector used to sense the developed image provides an important advantage in minimizing the effect of variables associated with temperature, such as the effect of shifts in the magnitude of the dark current of the photodetector and shifts in the light output from the light source. Other factors such as changes in the optical characteristics of the photoconductor due to oxidation and surface changes are also minimized. As a consequence of this dynamism, the system becomes insensitive to temperature, becomes insensitive to variations in component qualities, and insensitive to other variables as noted.

SUMMARY OF THE INVENTION

This invention is a quality control method and apparatus which retains all of the advantages of the related patent described above and improves on the disclosure of that patent by eliminating the need for the machine control to trigger the time at which a reference voltage is sensed and the time at which a sample voltage is sensed. In the instant invention, the light source is continually energized and the reference level is sensed and automatically held by a self-triggering feature when the sample voltage is sensed. In that manner, the two voltages may be compared and an output provided which can be reviewed by the machine control system at an opportune time to determine whether or not action is required to maintain copy quality. The circuit of this invention is much simpler than that of the related patent and provides a significant cost savings. The invention is explained below with reference to toner concentration control but is applicable to other quality control variables.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION a. In General

Figure 1:
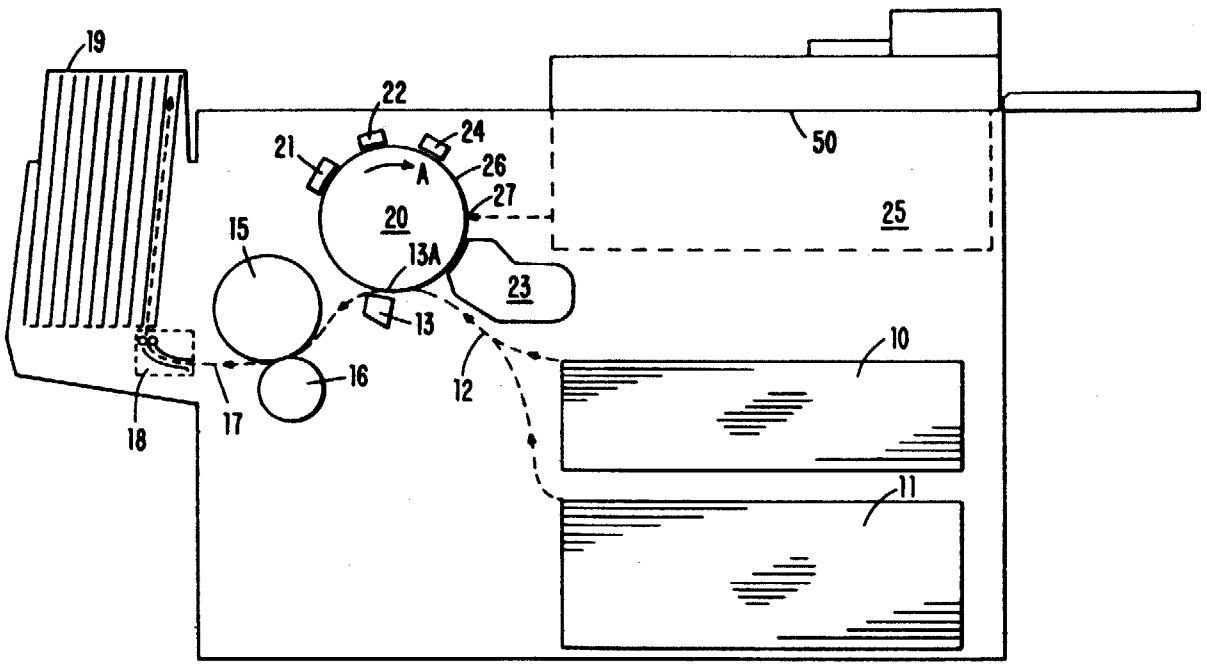
FIG. 1 shows a schematic layout of an electrophotographic machine utilizing the instant invention.

FIG. 1 shows a typical electrophotographic machine of the transfer type. Copy paper is fed from either paper bin 10 or paper bin 11 along guides 12 in the paper path to a transfer station 13A located just above transfer corona 13. At that station, an image is placed upon the copy paper. The copy paper continues through the fusing rolls 15 and 16 where the image is firmly attached to the copy paper and along path 17 into a movable deflector 18 and into one of the collator bins 19.

In order to produce an image on the photoconductive surface 26, a document to be copied is placed upon glass platen 50. An image of that document is transferred to the photoconductive surface 26 through an optics module 25 producing the image on the photoconductive surface 26 at exposure station 27. As the drum 20 rotates in the direction A, developer 23 deposits toner to develop the image which is then transferred to copy paper. As the photoconductor continues to rotate, it comes under the influence of preclean corona 22 and erase lamp 24 which discharges all of the remaining charged areas on the photoconductor. The photoconductor continues to pass around and through the developing station 23 (which is also a cleaning station in this embodiment) until it reaches the charge corona 21 where it is again charged prior to receiving another image at exposure station 27.

Figure 2:
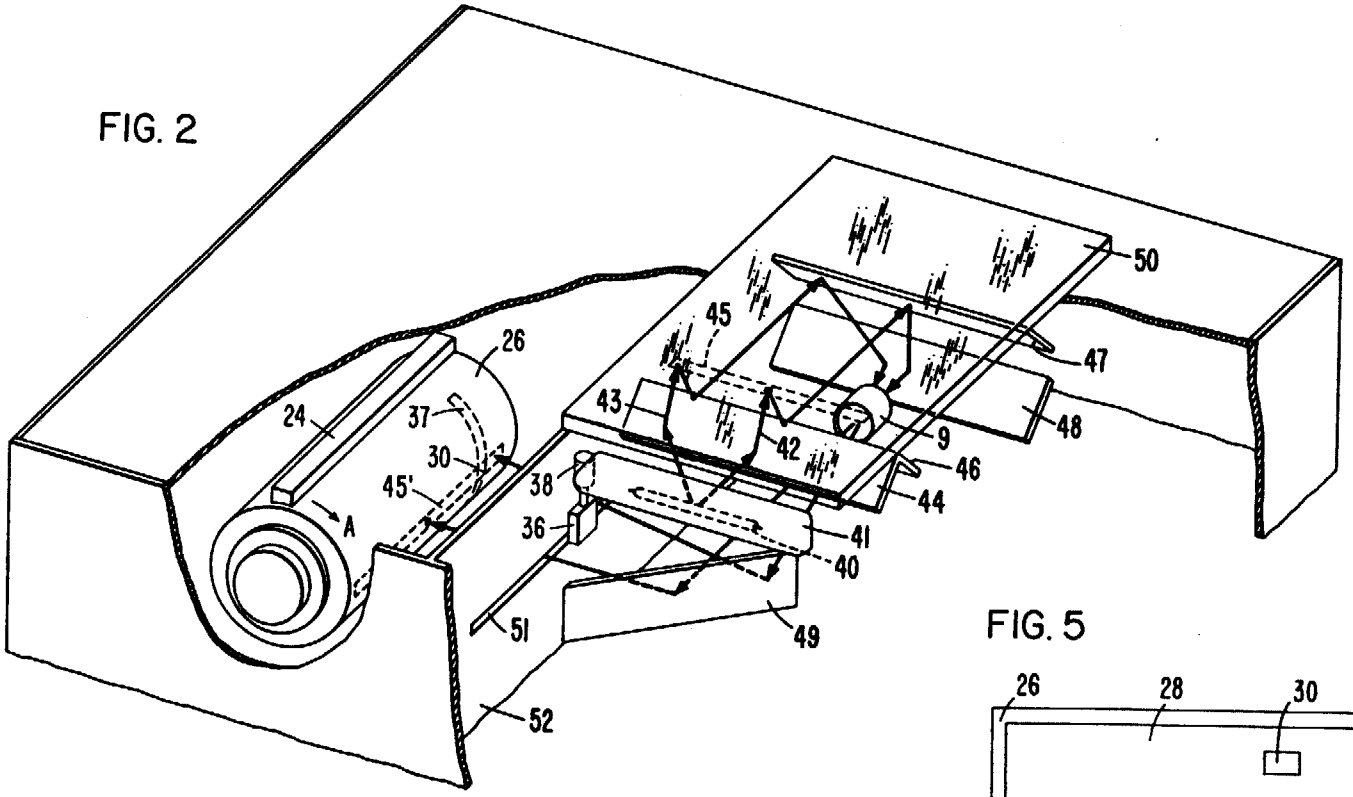
FIG. 2 shows the optical system and a photoconductive drum in the machine of FIG. 1.

FIG. 2 is a perspective of the optics system showing the document glass 50 upon which the document to be copied is placed. An illumination lamp 40 is housed in a reflector 41. Sample light rays 42 and 43 emanate from lamp 40 and are directed from dichroic mirror 44 to the document glass 50 whereat a line of light 45 is produced. Sample light rays 42 and 43 are reflected from the document placed on the document glass to reflective surface 46; from there to reflective surface 47 to reflective surface 48 and thence through lens 9 to another reflective surface 49. From mirror 49, the light rays are finally reflected through opening 51 in wall 52 to reach photoconductor 26 whereat a line of light 45' is produced. In that manner, a replica of the information contained in the line of light 45 on the glass platen 50 is produced on the photoconductor 26 at 45'. The entire length of a document placed on document glass 50 is scanned by motion of lamp 40 and the mirrors 44, 46, 47 and 48. By traversing the line of light 45 across the document at the same speed at which the line of light 45' is moved across photoconductor 26 by rotation of drum 20, a 1:1 copy of the document can be produced on the photoconductor 26.

Figures 3, 4:
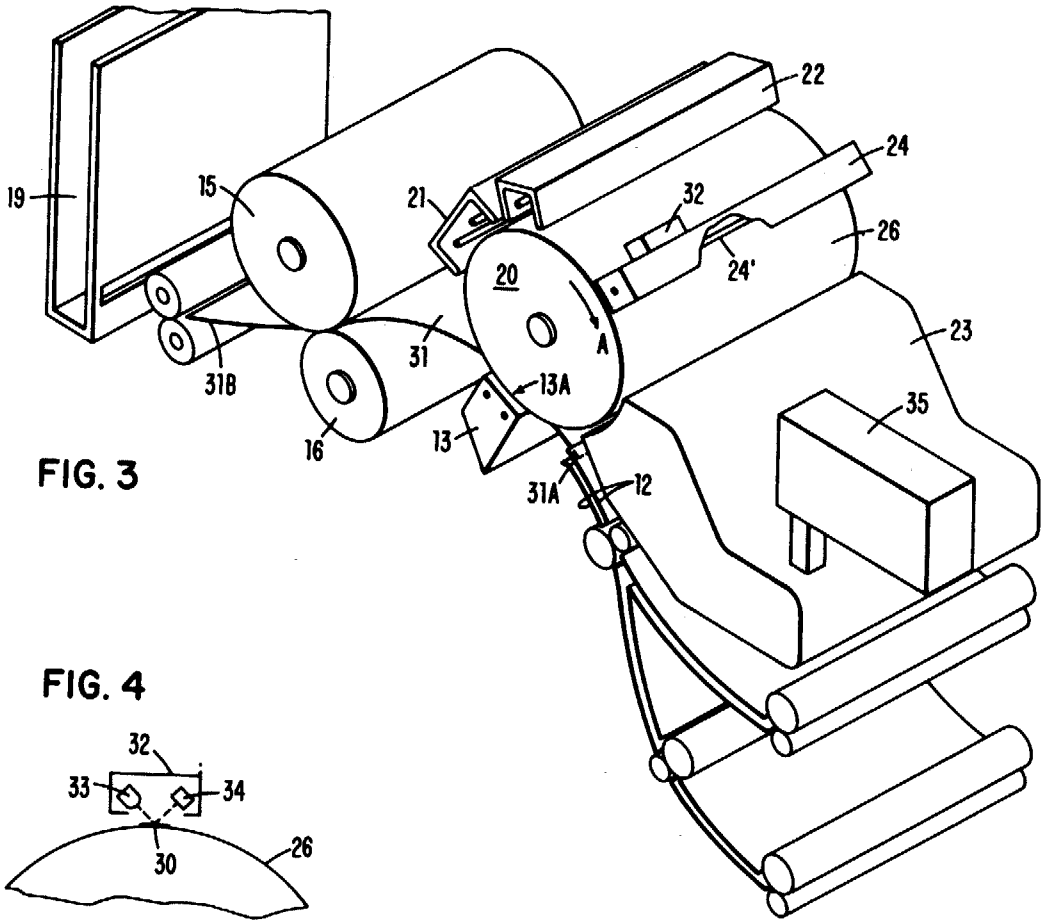
FIG. 3 is an idealized perspective view of components in the paper path of the machine.
FIG. 4 shows the reflectivity sensing elements of the toner concentration control device.

FIG. 3 shows the various elements in the paper path in perspective. Here a copy sheet 31 is shown with its trailing edge 31A in the paper path at guides 12. The copy paper is receiving an image at transfer station 13A and is in the process of having that image fused to itself by fuser rolls 15 and 16. The leading edge 31B of the copy paper is about to leave the document copier and proceed into the collator 19 which is represented in simplified form.

After an image is transferred to the copy paper, the photoconductor 26 continues to rotate until it comes under the influence of preclean corona 22 which applies a charge to the photoconductive surface to neutralize the remaining charge thereon. Photoconductor 26 continues to rotate until it comes under the influence of an erase light 24' in housing 24. The erase light produces illumination across the entirety of the photoconductor 26 in order to complete the discharge of any remaining areas on the photoconductive surface which have not been neutralized by the preclean corona 22. After passing under erase lamp 24', the photoconductor continues through the cleaning station of developer/cleaner 23, wherein any remaining toner powder not transferred to copy paper is cleaned from the photoconductor prior to the beginning of the next copy cycle.

In the next copy cycle, the charge corona 21 lays down a uniform charge across photoconductor 26 which charge is variably removed when the image of the document is placed on the photoconductor at the exposure station 27 shown in FIG. 1. Preclean corona 22 and erase lamp 24' are off during this cycle.

When the toner concentration control cycle is run, and if the result indicates a need to add toner to the developer, a signal is sent to replenisher 35 which holds a supply of toner and operates to dump a measured amount into the developer. In that manner, the toner density of the developer mix is replenished. Any suitable replenisher mechanism may be used including the replenisher described in IBM Technical Disclosure Bulletin, Vol. 17, No. 12, pp. 3516, 3517.

b. The Test Cycle

Figure 6:
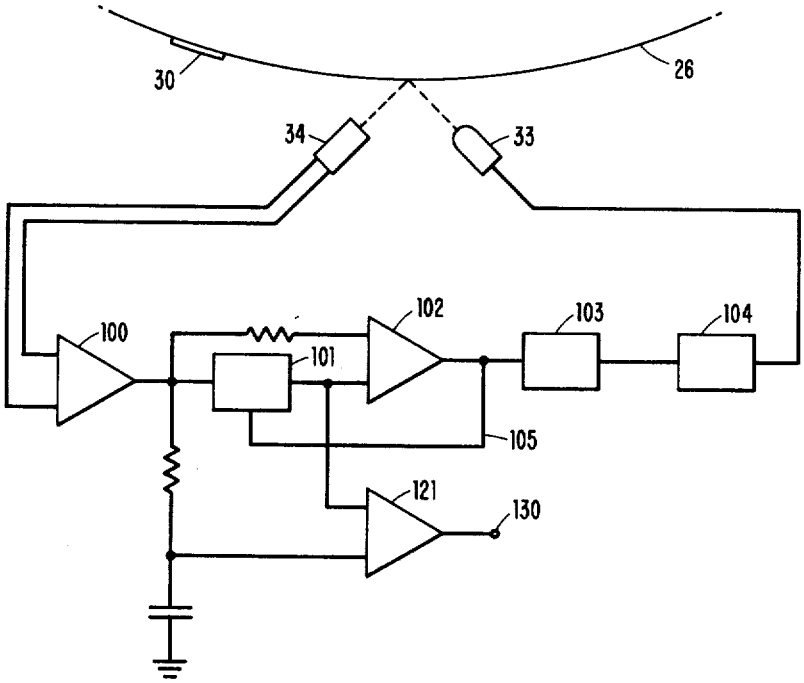
FIG. 6 shows a block diagram of a circuit employing the instant invention.

FIG. 3 shows a housing 32 containing the toner concentration control sensing system shown in FIGS. 4 and 6. When it is desired to sense for the concentration of toner in the developer mix, the photoconductor is charged as usual at the charge corona 21, but no image is placed on the charged photoconductor at exposure station 27. Instead, on this cycle, the erase lamp 24' remains on discharging all of the charge which has been laid down by charge corona 21 in order to provide bare photoconductor for a reference test area, except that the erase lamp 24' is momentarily interrupted to produce a charged stripe for a test area. If the lamp 24' is comprised of an array of light-emitting diodes, the array can be segmented such that only a few of the LEDs are momentarily turned off and therefore only a small "patch" of charge remains on the photoconductor at the conclusion of this part of the cycle. If a fluorescent tube is used as the erase lamp 24', momentarily reducing its energization to a low level will produce a "stripe" of charge remaining on the photoconductor at the conclusion of this part of the cycle.

Whether a stripe of charge or a patch of charge is produced, the charged test area continues to rotate in the direction A until it reaches the developer 23 where toner is placed onto the charged area to produce a toned sample test area. No copy paper is present at transfer station 13A in the test cycle, thus allowing the developed test area to continue its rotation in direction A until it approaches the toner concentration control housing 32. At this point, referring now to FIG. 4, a light-emitting diode (LED) or other suitable light source 33 produces light rays which reflect off the toned sample test area 30 and are reflected to a photosensor 34. It should be noted that the toned image could be transferred to copy paper, if desired. The reflectance of the developed and transferred stripe (or patch) would then be sensed by locating sensors on the paper path. It should also be noted that the principles of this system work well with photosensitive paper, i.e., electrophotographic machines in which the image is exposed directly onto the copy paper rather than through a transfer station.

Figure 5:
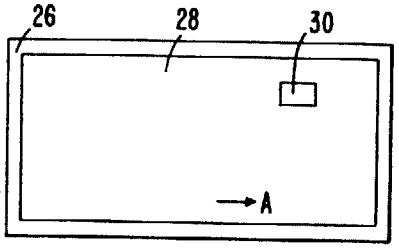
FIG. 5 shows the layout of the photoconductor with the location of the bare reference area and the developed test area within the document reproduction image area.

FIG. 5 shows the layout of the photoconductor 26 with an image area 28 outlined therein. A developed patch 30 has been produced within the image area 28. FIG. 2 shows apparatus for producing patch 30. As described above, erase lamp 24' is momentarily interrupted to produce a stripe of charge. While the above description designated 45' as a line of light producing an image on photoconductor 26, suppose now that during the test cycle the line or stripe 45' is used to designate a stripe of charge produced by momentarily interrupting lamp 24'. Suppose also that document lamp 40 is turned on during the test cycle so that light from lamp 40 will erase the stripe of charge 45' unless it is interrupted. Such an interruption is made possible by the provision of shutter 36 which is shown in FIG. 2 as dropping across slot 51 in wall 52. Shutter 36 is actuated by solenoid 38. As a result, light from lamp 40 is blocked away from photoconductor 26 by shutter 36, thus producing a stripe of charge 37. Of course, erase lamp 24' will erase all of stripe 37 except for patch 30. In that manner, a patch instead of a stripe can be produced. Note that slot 51 should be positioned close to the photoconductive surface 26.

c. The Circuit—FIGS. 6 and 7

A circuit to implement this invention is similar to that described in the related patent named above, in that it is designed to control the density of a toned patch on the photoconductor such that the reflectance ratio of toned-to-untoned photoconductor remains constant. Density control is achieved by adjusting the toner concentration in the developer mix with the ultimate goal to maintain constant output copy density.

The improved circuit of this invention senses the reflectance of the photoconductor continuously with the light-emitting diode 33 producing a continuous output. Thus, as the various images are produced and developed on the photoconductive surface 26, the transducing elements 33 and 34 will continually sense the density level of those images and produce corresponding responses in the circuit network shown in FIGS. 6 and 7. However, the output signal will not be sensed during ordinary image production since it is only interrogated by the machine control during a quality control test cycle.

During the quality control test cycle, LED 33 and photosensor 34 sense the untoned reflectance of the base photoconductive surface to produce a signal which is amplified by circuit 100 and stored in sample circuit 101. This untoned reflectance reference signal is stored automatically when the toned sample patch 30 passes across the photosensor 34 and, after a short time delay, the LED output 33 is automatically increased so that the toned photoconductor reflectance signal is approximately equal to the reference signal. The stored reference signal and the adjusted sample signal are compared and if the density of patch 30 is at a proper level, this comparison will be approximately equal and result in no output signal. If, however, the density of patch 30 has decreased, the output signal of the comparator will produce an output to cause the replenisher 35 to add toner to the developer mix contained in the reservoir of developer 23.

The circuit of FIG. 6 operates in the following manner: Photosensor 34 senses the reflectance level of the bare photoconductor 26 and produces a certain output which is fed into the amplifier 100. The output of amplifier 100 is detected by detector 102 and fed to the current driver 103. The output of current driver 103 adjusts the current source 104 such that the LED 33 produces the light output to drive the circuit to a steady state condition indicative of untoned bare photoconductor. During the operation of the circuit, the voltage level output of amplifier 100 is stored in the sample circuit 101. When the toned sample patch 30 passes across the LED 33 and photosensor 34, the reflectance level suddenly changes resulting in a much lowered output from amplifier 100. This much lowered output is detected at 102 and causes the reference voltage in sample circuit 101 to be stored through line 105 which disconnects the storage elements in circuit 101 from the amplifier 100. The much lowered output of detector 102 also causes the current driver 103 to drive the current source 104 to produce a much higher current level to energize the LED 33 to a level which drives the input to amplifier 100 to a level equal to approximately the previous reference input.

Figure 7:
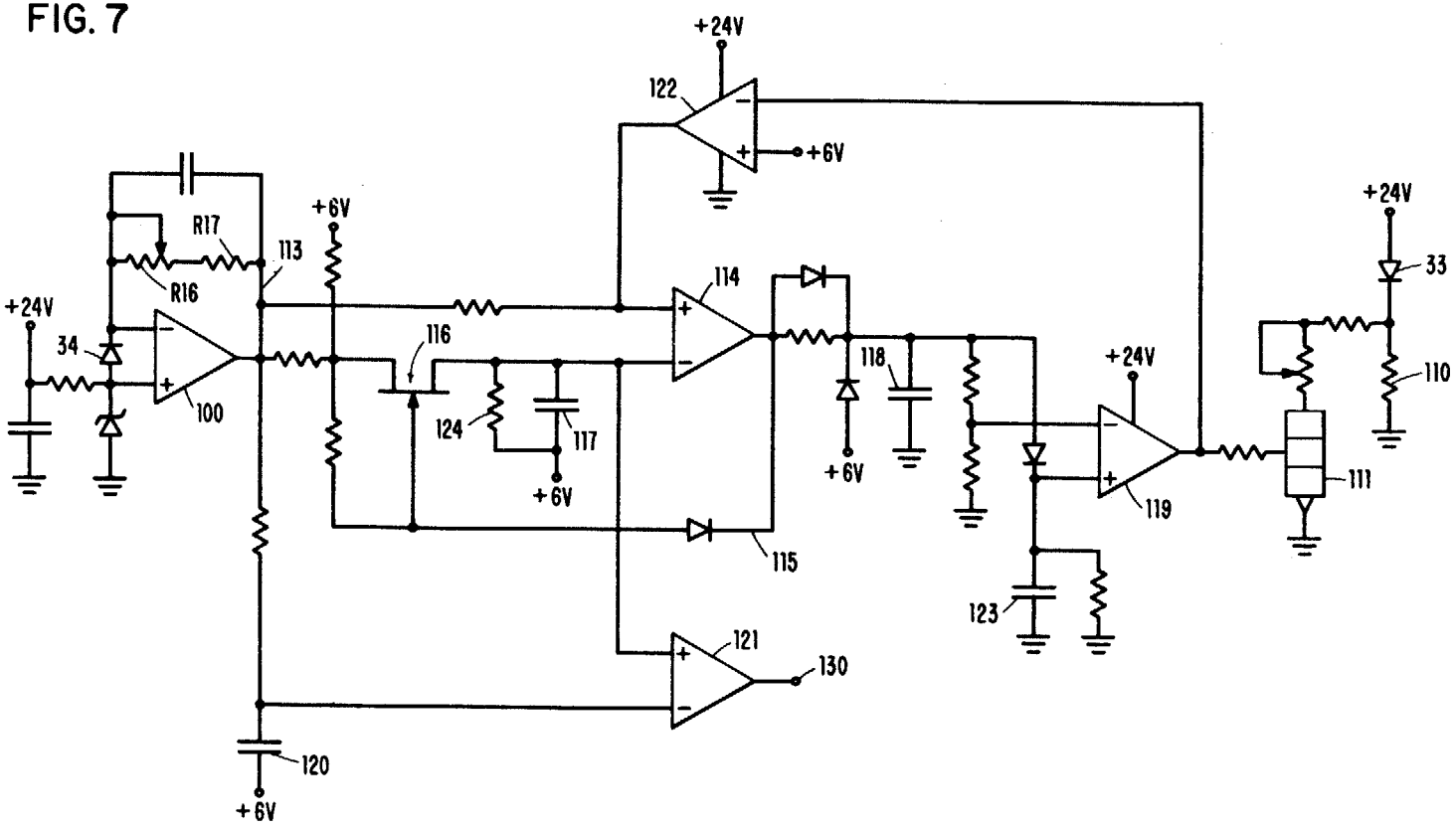
FIG. 7 is a detailed schematic diagram of the circuit of FIG. 6.

The detailed implementation of FIG. 6 is shown in FIG. 7. When viewing the untoned bare photoconductor, LED 33 is energized from a 24-volt source through resistor 110. A second and much higher level of current is produced when viewing the toned sample by energizing transistor switch 111. The output of LED 33 is sensed by the photosensor 34 to produce an input to the current to voltage amplifier 100. When the toned sample is sensed, a significant drop in the current flow through sensor 34 results in a significant voltage decrease across resistors R16 and R17, thus creating a lower voltage level on line 113. The result is a significant drop in the output of the level detector 114 which results in opening FET switch 116 to disconnect the capacitor 117 from amplifier 100. In that manner, the untoned reference voltage level which had built up on capacitor 117 is stored here. In that manner, the level sensor 114 acts to sense the presence of the toned patch at the photosensor and triggers the storing of the reference value. Also, as a result of the drop in output from detector 114, capacitor 118 discharges to create a time delay before turning on the one-shot current driver amplifier 119. When amplifier 119 turns on, transistor switch 111 is closed to increase the current flow through LED 33. The increased current flow through LED 33 is designed to excite photosensor 34 to the same level at which it was excited when viewing bare photoconductor. Thus, the output of amplifier 100 should be restored to the same value that it had when viewing bare photoconductor. This output is reflected on capacitor 120 and is compared at feed comparator 121 to the reference voltage which has been stored on capacitor 117. Thus, if the two inputs to the feed comparator 121 are approximately equal, there will be no output signal. However, if the density of the toned sample has decreased, the output of amplifier 100 will be higher than normal thus creating a higher than normal voltage on capacitor 120 thus causing the feed comparator 121 to produce an output signal. At an opportune time in the machine control cycle, the output signal will be interrogated and the toner replenisher will be energized to improve the density of the toned sample if the test reveals that need. During this period, the FET switch 116 remains open due to the action of latching amplifier 122.

To summarize, first the sensor 34 views an untoned area of the photoconductor and produces a current which is converted to a voltage by amplifier 100. The output of amplifier 100 is coupled to a passive integrator including capacitor 117. When the toned sample passes across the transducer, the photosensor current decreases rapidly. This transition is sensed immediately on line 113 and is detected by the detector 114. This results in opening FET switch 116 and in discharging capacitor 118 through detector 114 so that after an appropriate time delay, the current drive source amplifier 119 is switched to close transistor switch 111 causing a higher LED current to flow.

With the increased current flow through LED 33, more light is produced and the photocell is excited to produce a current which should be approximately the same current produced when the photocell views bare photoconductor, assuming that the density is correct. This new signal voltage will again be passively integrated but at this time the FET switch 116 will remain off because OP AMP 122 is latched low by the action of amplifier 119. The output of comparator 121 is sensed during the time that OP AMP 122 is latched low. This time is determined by capacitor 123, which discharges over a selected time period after which one-shot current source 119 is operated to open transistor 111, release OP AMP 122, and energize LED 33 at an excitation level proper for viewing bare photoconductor in subsequent tests.

It may be noted that resistor 124 is to insure that bias currents through detector 114 will not charge capacitor 117 to abnormally high voltages and destroy the validity of the output comparison.

The invention can be used for quality control tests other than toner concentration control and can be utilized in environments other than described herein. For example, the description herein calls for testing areas located within that portion of the photoconductor normally used for document reproduction. Such an environment is advantageous but not required by the instant invention.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A process for indicating changes in light reflectivity of adjacent surface areas on a moving web using a device having a light source positioned for illuminating said areas and a light sensitive element positioned for receiving light originated from said source but reflected from said surface areas with said element producing a sense signal corresponding in magnitude to said received light, said process comprising the steps of:

coupling a signal storage device to said element sense signal continuously while said element sense signal is in a reference condition;

detecting a substantial magnitude change of said element sense signal when the sense signal enters a sample condition;

responding to said detecting step by isolating said storage device and by changing the magnitude of the sample signal to approximately equal said reference signal if a correct quality condition is present;

comparing the magnitude of the adjusted sample signal with the stored reference signal; and producing an output indication in response to failure of said adjusted sample signal and said reference signal to compare approximately equally in said comparing step.

2. In an electrophotographic copier machine wherein images of documents to be copied are produced on photoreceptive material, said machine including a developer to apply toner to said images and light reflectance sensing means to view said photoreceptive material, a quality control checking method including the steps of:

(1) producing a charged sample test area and a discharged reference test area on said photoreceptive material;

(2) developing said charged test area;

(3) using an illumination sensing means to measure the reflectivity of said discharged reference test area to establish a reference signal indicative of clean photoreceptor and storing said reference signal in a signal storage device;

(4) using the identical sensing means to measure the reflectivity of the developed test area to establish a sample signal indicative of the quality of a toned image;

(5) detecting a substantial change in magnitude when the sensed signal changes from its reference value to its sample value;

(6) in response to said detecting step, isolating said signal storage device and changing the magnitude and said sample signal to approximately equal said reference signal if a correct quality condition is present and;

(7) comparing said adjusted sample signal and the stored reference signal to produce an output signal indicative of quality.

3. Quality control test apparatus for an electrophotographic machine comprising:

a photoreceptive material;

charge corona means for charging said photoreceptive material;

erase means for discharging a portion of said photoreceptive material to establish a discharged test area and a charged test area for a toned sample;

developing means for placing toner on said charged test area to provide said toned sample;

single light sensitive means for receiving light rays reflected from said discharged test area to establish a reference sense signal indicative of the light reflecting capability of clean photoreceptor and for receiving light rays reflected from said toned sample to establish a sample sense signal indicative of the light reflecting capability of the developed test area;

signal storage means electrically connected to said light-sensitive means for storing the reference sense signal of said light-sensitive means;

detecting means connected to said light-sensitive means for detecting a substantial change in magnitude when the sensed signal changes from its reference value to its sample value;

isolating means connected to said detecting means and said signal storage means to disconnect said signal storage means from said light-sensitive means in response to the detection of a sample signal;

adjusting means connected to said detecting means and said light-sensitive means for adjusting the value of the sample signal to approximately equal the reference value if quality conditions are correct in response to the detection of a sample signal; and comparison means connected to said light-sensitive means and said signal storage means to compare the adjusted sample value and the reference value to produce an output signal indicative of quality.

4. The quality control test apparatus of claim 3 wherein said adjusting means includes a light source for producing said light rays and a current source for driving said light source, said current source connected to said light source and to said detecting means, said current source acting to increase the excitation of said light source in response to the detection of a sample signal.

* * * * *